United States Patent [19]

Kawanabe et al.

[11] Patent Number: 4,715,352

[45] Date of Patent: Dec. 29, 1987

[54] AIR INTAKE SIDE SECONDARY AIR SUPPLY SYSTEM FOR AN INTERNAL COMBUSTION ENGINE WITH A DUTY RATIO CONTROL OPERATION

[75] Inventors: Tomohiko Kawanabe; Masahiko Asakura; Noritaka Kushida; Katsuhiko Kimura, all of Wako, Japan

[73] Assignee: Honda Giken Kogyo Kabushiki Kaisha, Tokyo, Japan

[21] Appl. No.: 912,038

[22] Filed: Sep. 29, 1986

[30] Foreign Application Priority Data

Sep. 30, 1985 [JP] Japan ..... 60-218503

[51] Int. Cl.[4] ..... F02M 23/04

[52] U.S. Cl. ..... 123/589

[58] Field of Search ..... 123/585, 589, 339

[56] References Cited

U.S. PATENT DOCUMENTS 4,356,797 11/1982 Matsui ..... 123/589
4,579,099 4/1986 Kishida et al. ..... 123/589
4,580,541 4/1986 Koumura ..... 123/589
4,586,481 5/1986 Kishida et al. ..... 123/589

*Primary Examiner*—William A. Cuchlinski, Jr.
*Attorney, Agent, or Firm*—Pollock, VandeSande & Priddy

[57] ABSTRACT

An air intake side secondary air supply system for an internal combustion engine including an open/close valve disposed in an air intake side secondary air supply passage and an oxygen concentration sensor producing an output signal whose level is substantially proportional to an oxygen concentration of the exhaust gas, executes a duty ratio control of the open/close valve for a feedback control of the air fuel ratio of mixture to be supplied to the engine. When the air/fuel ratio has changed from rich to lean with respect to a target air/fuel ratio, a correction value for reducing the valve open period during the air/fuel ratio is detected to be lean, is increased. On the other hand, when the air/fuel ratio has changed from lean to rich with respect to the target air/fuel ratio, a correction value for increasing the valve open period during the air/fuel ratio is detected to be rich, is increased.

1 Claim, 8 Drawing Figures

537
$L_{O2} > L_{ref}$
NO
YES
538
$F_{AF} = 1$
NO
YES
539
CALCULATE THE SUBTRACTION VALUE $I_L$
5310
$I_{OUT} = I_{OUT} - I_L$
5311
CALCULATE THE SUBTRACTION VALUE $P_L$
5312
$I_{OUT} = I_{OUT} - P_L$
5314
$F_{AF} = 0$
NO
YES
5315
CALCULATE THE SUMMING VALUE $I_R$
5316
$I_{OUT} = I_{OUT} + I_R$
5317
CALCULATE THE SUMMING VALUE $P_R$
5318
$I_{OUT} = I_{OUT} + P_R$
5313
$F_{AF} = 1$
5319
$F_{AF} = 0$
5320
$T_{OUT} = D_{BASE} + I_{OUT}$
RETURN

AIR INTAKE SIDE SECONDARY AIR SUPPLY SYSTEM FOR AN INTERNAL COMBUSTION ENGINE WITH A DUTY RATIO CONTROL OPERATION

BACKGROUND OF THE INVENTION

1. Field of the Invention

The present invention relates to an air/fuel ratio control system for an internal combustion engine, and more particularly a system in which an air/fuel ratio of mixture to be supplied to the engine is controlled toward a target value in response to an output signal level of an oxygen concentration sensor.

2. Description of Background Information

Air/fuel ratio feedback control systems for an internal combustion engine are known as systems in which oxygen concentration in the exhaust gas of the engine is detected by an oxygen concentration sensor (referred to as $O_2$ sensor hereinafter) and an air/fuel ratio of mixture to be supplied to the engine is feedback controlled in response to an output signal level of the $O_2$ sensor for the purification of the exhaust gas and improvements of the fuel economy. As an example of the air/fuel ratio feedback control system, an air-intake side secondary air supply system for the feedback control is proposed, for example, in Japanese Patent Publication No. 55-3533 in which an open-close valve is disposed in an air intake side secondary air supply passage leading to a carburetor of the engine and a duty ratio of the open and close of the open-close valve, i.e. the supply of the air intake side secondary air, is feedback controlled in response to the output signal level of the $O_2$ sensor.

In the usual air/fuel ratio feedback control systems, it is general that the air/fuel ratio of the mixture supplied to the engine is controlled toward a target air/fuel ratio which is determined previously. Therefore, it is desirable that the amount of the secondary air is controlled by a duty ratio control operation so that the response characteristic of the air/fuel ratio control is fast enough, without causing a large deviation or hunting of the air/fuel ratio from the target air/fuel ratio.

OBJECTS AND SUMMARY OF THE INVENTION

An object of the present invention is to provide an air intake side secondary air supply system by which very accurate control of the air/fuel ratio toward a target air/fuel ratio is enabled.

According to the present invention, an air intake side secondary air supply system is constructed to determine a base valve open period in each duty cycle of an open-close valve disposed in an air intake side secondary air supply passage, in accordance with a plurality of engine operating parameters at intervals of a predetermined time period. In response to an output signal level of the oxygen concentration sensor, whether the air/fuel ratio of a mixture supplied to the engine is lean or rich with respect to a target air/fuel ratio is determined at most at intervals of the said predetermined time period. When the detected air/fuel ratio is lean, the base valve open period is reduced by a first predetermined correction value, to provide a corrected value as an output valve open time period. When, on the other hand, the detected air/fuel ratio is rich, the valve open period is increased by a second correction value, to provide the corrected value as the output valve open period. The open-close valve is opened during the thus calculated output valve open period, in each of the duty cycle. The first correction value is increased only when the air/fuel ratio of the mixture is changed from rich to lean with respect to the target air/fuel ratio. The second correction value is increased only when the air/fuel ratio of the mixture supplied to the engine is changed from lean to rich with respect to the target air/fuel ratio.

BRIEF DESCRIPTION OF THE DRAWINGS

FIGS. 4, 5A and 5B are flowcharts showing the manner of operation of a CPU 29 in the control circuit 20 in an embodiment of the air/fuel ratio control system according to the present invention, in which FIG. 4 shows a main routine, FIGS. 5A and 5B, when combined, show an A/F routine;

FIG. 5 shows the juxtaposition of FIGS. 5A and 5B;

DETAILED DESCRIPTION OF THE PREFERRED EMBODIMENT

Referring to the accompanying drawings, the embodiment of the air intake side secondary air supply system according to the present invention will be explained hereinafter.

Figure 1:
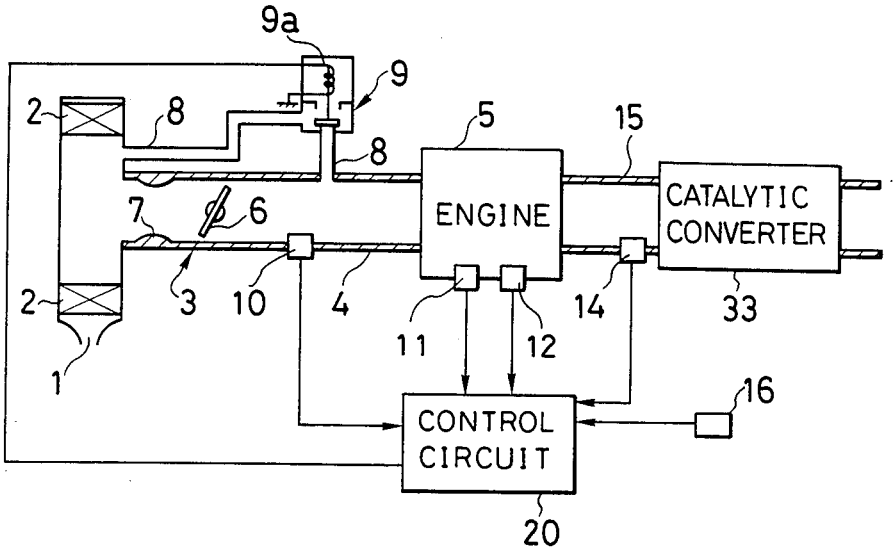
FIG. 1 is a schematic diagram showing a general construction of the system according to the invention.

In FIG. 1 which illustrates a general construction of the air intake side secondary air supply system for an automotive internal combustion engine, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid **9*a*** thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean $O_2$ sensor 14 which is provided in an exhaust manifold 15 of the engine for generating an output signal whose level varies in proportion to an oxygen concentration in the exhaust gas.

Figure 2:
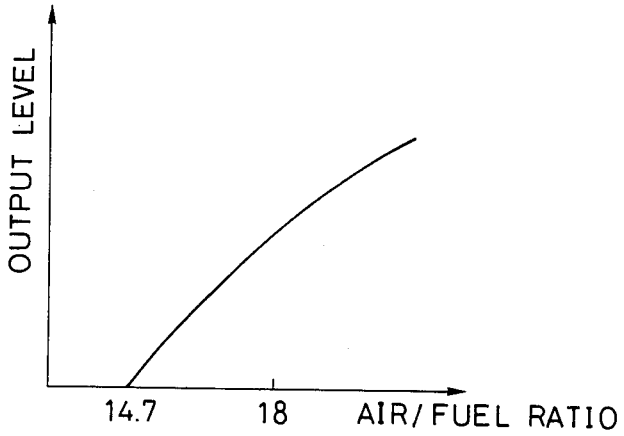
FIG. 2 is a diagram showing a signal output characteristic of the $O_2$ sensor 14 used in the system of FIG. 1.

FIG. 2 shows a signal output characteristic of the $O_2$ sensor 14. As shown, the output signal level of the $O_2$ sensor increases proportionally as the oxygen concentration in the exhaust gas becomes leaner from a stoichiometric air/fuel ratio (14.7). Further, a catalytic converter 33 for accelerating the reduction of the noxious components in the exhaust gas is provided in the exhaust manifold 15 at a location on the downstream side of the position of the $O_2$ sensor 14. The open/close solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is proportional to the speed of the vehicle is electrically connected to the control circuit 20.

Figure 3:
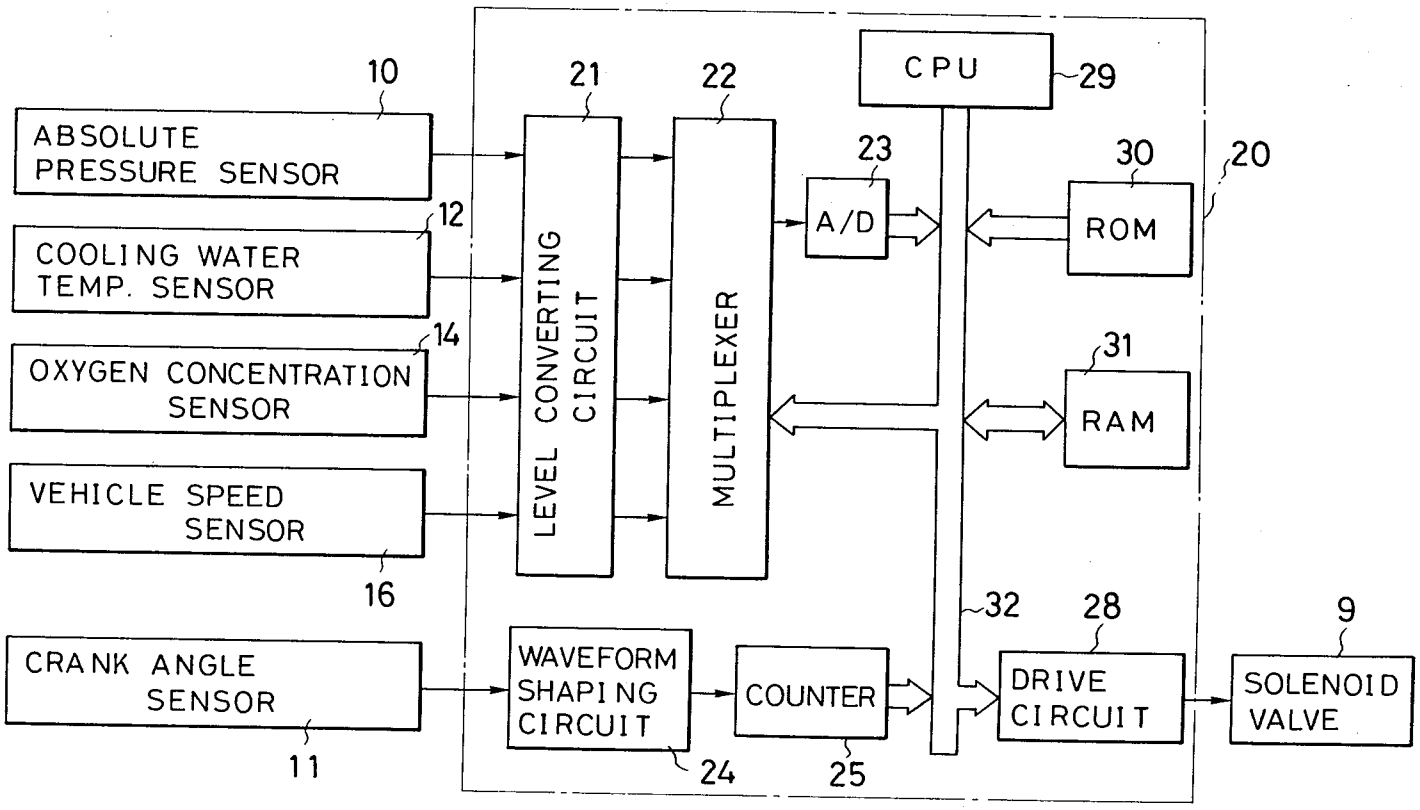
FIG. 3 is a block diagram showing the concrete construction of the control circuit 20 of the system of FIG. 1.

FIG. 3 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the open/close solenoid valve 9 in an opening direction, a CPU (central processing unit) 29 which performs digital operations according to various programs, and a ROM 30 in which various operating programs and data are previously stored, and a RAM 31. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter.

Figure 4:
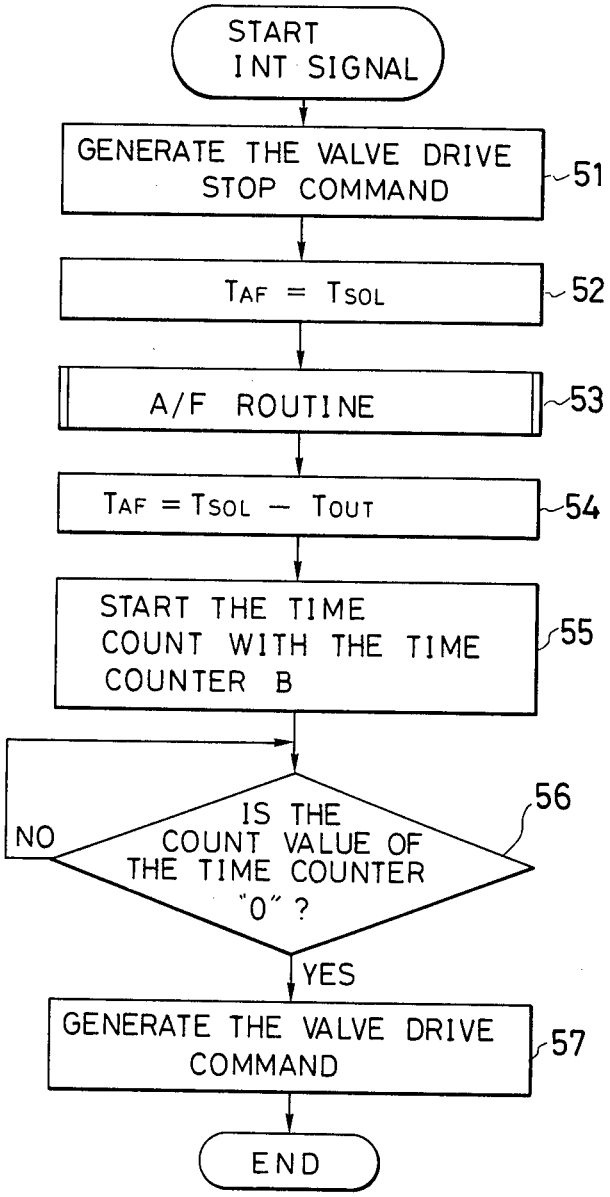
Figure 5A:
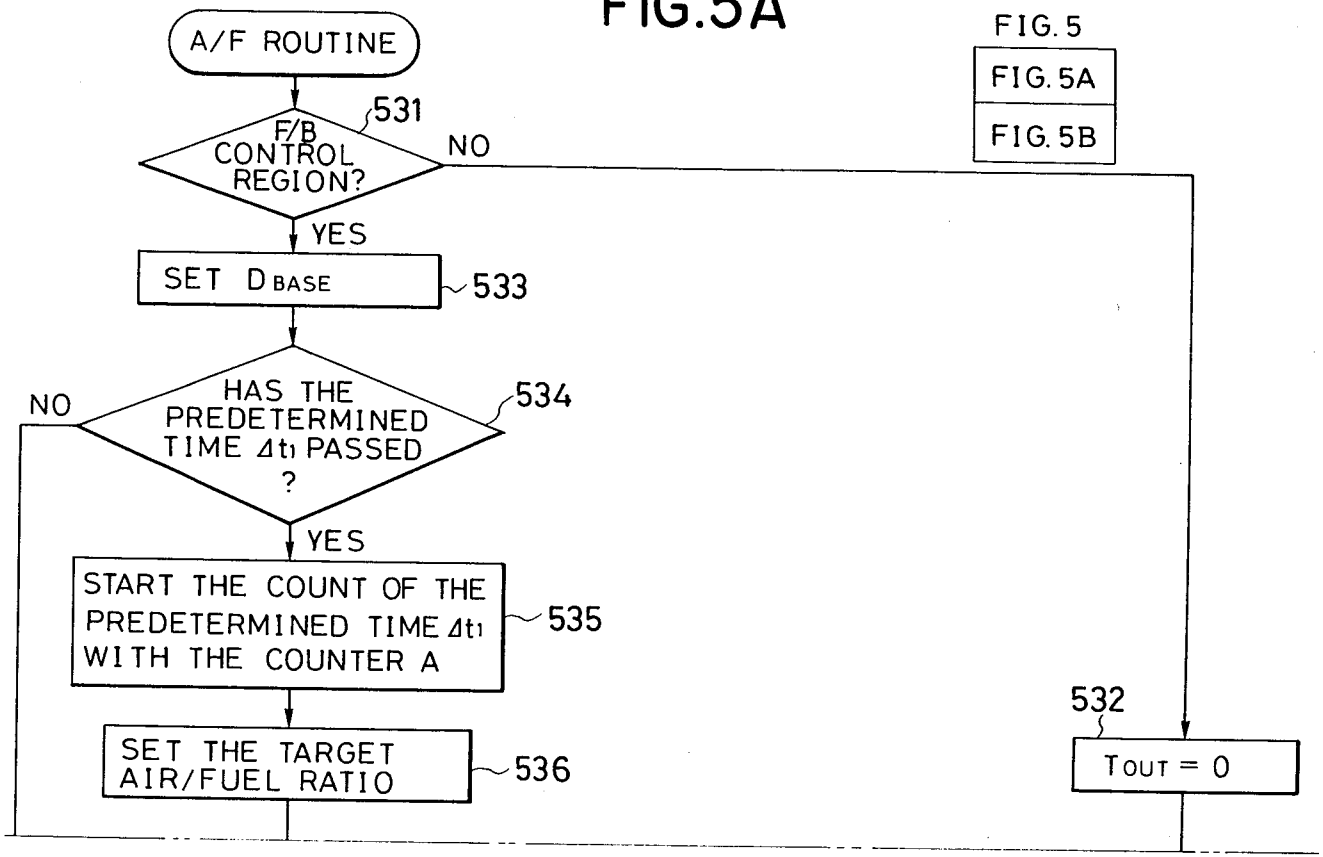
Figure 5B:
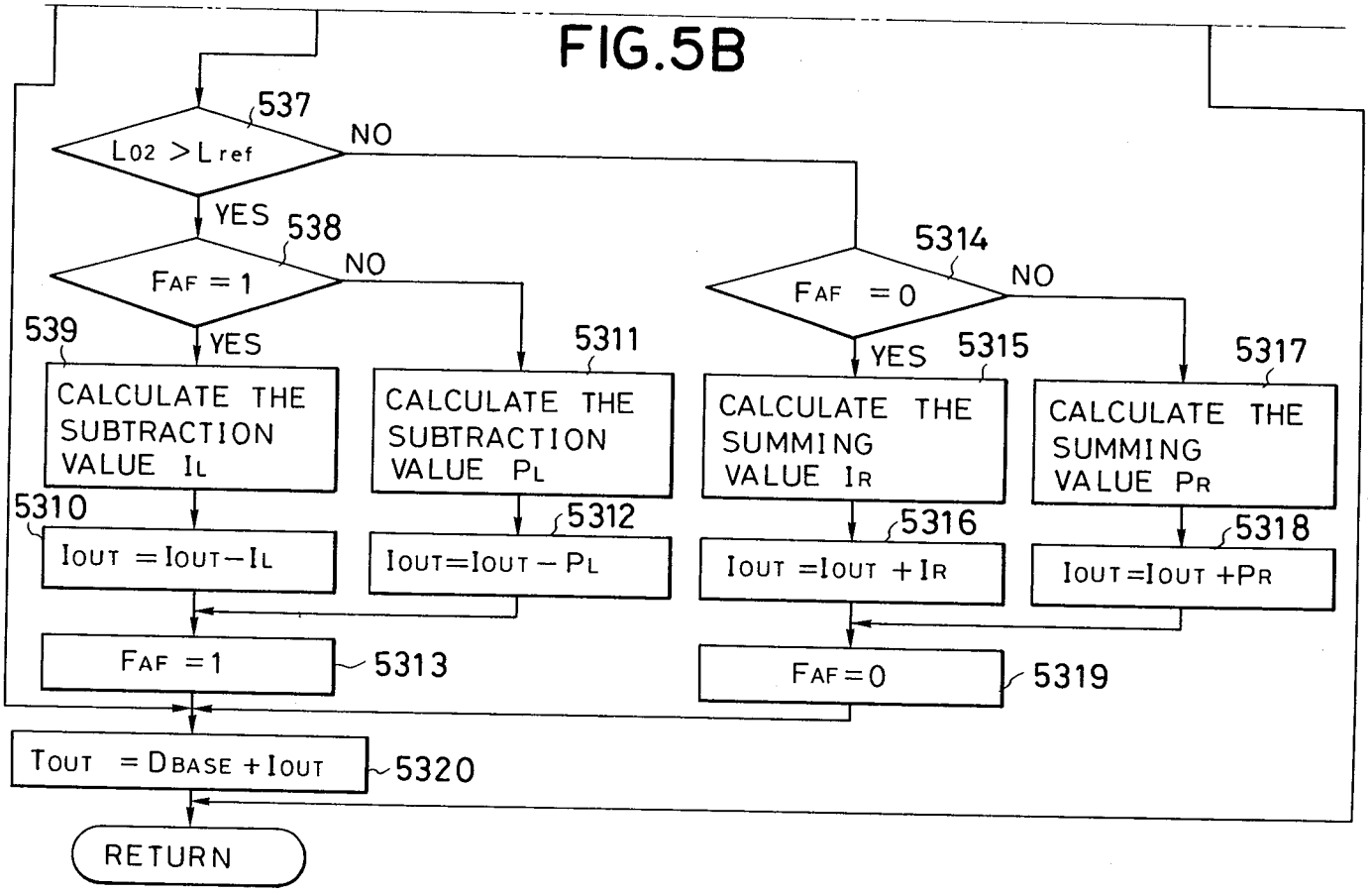

Referring to the flowcharts of FIGS. 4 and 5, the operation of the air/fuel ratio control system according to the present invention will be explained hereinafter.

At a step 51, a valve open drive stop command signal is generated in the CPU 29 and supplied to the drive circuit 28, at every time of the generation of the internal interruption signal in the CPU 29. With this signal, the drive circuit 28 is controlled to close the open/close solenoid valve 9. This operation is provided so as to prevent malfunctions of the open/close solenoid valve 9 during the calculating operation of the CPU 29. Nextly, a valve close period $T_{AF}$ of the open/close solenoid valve 9 is made equal to a period of one duty cycle $T_{SOL}$ at a step 52, and an A/F routine for calculating a valve open period $T_{OUT}$ of the open/close solenoid valve 9 which is shown in FIG. 5 is carried out through steps generally indicated at 53.

Figure 6:
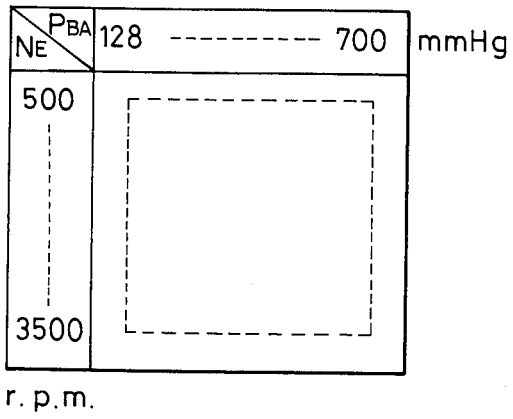
FIG. 6 is a diagram showing a data map which is previously stored in a ROM 30 of the control circuit 20.

In the A/F routine, whether or not the operating state of the vehicle (including operating states of the engine) satisfies a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air/fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/close solenoid valve 9 is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 6, and the CPU 29 at first reads current values of the absolute pressure $P_{BA}$ and the engine speed $N_e$ and in turn searches a value of the period of base duty ratio $D_{BASE}$ corresponding to the read values from the $D_{BASE}$ date map in the ROM 30. Then, whether or not a count period of a time counter A incorporated in the CPU 29 (not shown) has reached a predetermined time period $\Delta t_1$ is detected at a step 534. This predetermined time period $\Delta t_1$ corresponds to a delay time from a time of the supply of the air intake side secondary air to a time in which a result of the supply of the air intake side secondary air is detected by the $O_2$ sensor 11 as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the intital value by the time counter A, i.e. the execution of the step 535, is performed at the step 534. After the start of the counting of the predetermined time period $\Delta t_1$ by the time counter A in this way, a target air/fuel ratio which is leaner than the stoichiometric air/fuel ratio is set at a step 536.

For setting this target air/fuel ratio, various values for the reference level Lref which is determined according to the values of the absolute pressure within the intake manifold $P_{BA}$ and the engine speed $N_e$ as in the case of the $D_{BASE}$ data map, are previously stored in the ROM 30 as an A/F data map. The CPU 29 searches a value of the reference level Lref from the A/F data map in the ROM 30 using current values of the absolute pressure $P_{BA}$ and the engine speed $N_e$. After the set of the reference value Lref in this way, whether or not the output signal level of the oxygen concentration sensor 14 is greater than the reference value Lref determined at the step 536 is detected at a step 537. In other words, whether or not the air/fuel ratio of mixture is leaner than the target air/fuel ratio is detected at the step 537.

If $LO_2 > Lref$, it means that the air/fuel ratio of the mixture is leaner than the target air/fuel ratio, whether or not a flag $F_{AF}$ is equal to "1" is detected at a step 538. If $F_{AF}=1$, it means that the air/fuel ratio was detected to be lean in a previous detection cycle. Then, a subtraction value $I_L$ is calculated at a step 539. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of operations of the A/F routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 5310. On the other hand, if $F_{AF}=0$, it means that the air/fuel ratio was detected to be rich in the previous detection cycle and the air/fuel ratio has turned to be lean from the rich state. Therefore, a subtraction value $P_L$ is calculated at a step 5311. The subtraction value $P_L$ is obtained by a multiplication between the subtraction value $I_L$ and a constant $K_3$ ($K_3 > 1$). After the calculation of the subtraction value $P_L$, the correction value $I_{OUT}$ which is previously calculated by the execution of operations of the A/F routine is read out from the memory location $a_1$ in the RAM 31. Subsequently, the subtraction value $P_L$ is subtracted from the correction value $I_{OUT}$, and a result is in turn written in the memory location $a_1$ of the RAM 31 as a new correction value $I_{OUT}$, at a step 5312. After the calculation of the correction value $I_{OUT}$ at the step 5310 or the step 5312, a value "1" is set for the flag $F_{AF}$, at a step 5313, for indicating that the air/fuel ratio is lean. On the other hand if $LO_2 \leqq Lref$ at the step 537, it means that the air/fuel ratio is richer than the target air/fuel ratio. Then whether or not the air/fuel ratio flag $F_{AF}$ is "0" is detected at a step 5314. IF $F_{AF}=0$, it means that the air/fuel ratio was detected to be rich in the previous detection cycle. Then a summing value $I_R$ is calculated at a step 5315. The summing value $I_R$ is calculated by a multiplication among a constant value $K_2$ ($\neq K_1$), the engine speed $N_e$, and the absolute pressure $P_{BA}$ $(K_2 \cdot N_e \cdot P_{BA})$, and is dependent on the amount of the intake air of the engine 5. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 5316. If $F_{AF}=1$ at the step 5314, it means that the air/fuel ratio was detected to be lean in the previous detection cycle, and the air/fuel ratio has turned to be rich from the lean condition. Then a summing value $P_R$ is calculated at a step 5317. The summing value $P_R$ is obtained by a multiplication between the summing value $I_R$ and a constant $K_4$ ($K_4 > 1$). After the calculation of the summing value $P_R$, the correction value $I_{OUT}$ which is previously calculated by the execution of operations of the A/F routine is read out from the memory location $a_1$ in the RAM 31. Subsequently, the summing value $P_R$ is added to the correction value $I_{OUT}$, and a result is in turn written in the memory location $a_1$ of the RAM 31 as a new correction value $I_{OUT}$, at a step 5318. After the calculation of the correction value $I_{OUT}$ at the step 5316 or the step 5318, a value "0" is set for the flag $F_{AF}$, at a step 5319, for indicating that the air/fuel ratio is rich. After the calculation of the correction value $I_{OUT}$ at the step 5310, 5312, 5316 or 5318 in this way, the correction value $I_{OUT}$ and the period of base duty ratio $D_{BASE}$ set at the step 533 are added together, and a result of addition is used as the valve open period $T_{OUT}$ at a step 5320.

Additionally, after the reset of the time counter A and the start of the counting from the initial value at the step 535, if it is detected that the predetermined time period $\Delta t_1$ has not yet passed, at the step 534, the operation of the step 5320 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$ at a step 54. Subsequently, a value corresponding to the valve close period $T_{AF}$ is set in a time counter B incorporated in the CPU 29 (not shown), and down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is executed repeatedly.

Figure 7:
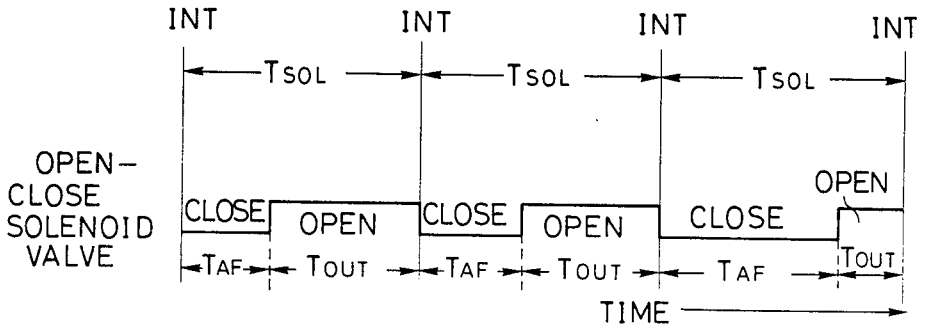
FIG. 7 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 7, to stop the supply of the air intake side secondary air to the engine 5. When the valve close time $T_{AF}$ for the open/close solenoid valve 9 within the period of one duty cycle $T_{SOL}$ is calculated and the valve close time $T_{AF}$ has passed after the generation of the interruption signal, the open/close solenoid valve 9 is opened to supply the air intake side secondary air to the engine through the air intake side secondary air supply passage 8. Thus, the duty ratio control of the supply of the air intake side secondary air is performed by repeatedly executing these operations. Further, the air/fuel ratio of the mixture to be supplied to the engine 5 is controlled to the target air fuel ratio by a duty ratio control of the supply of the air intake side secondary air.

In the air intake side secondary air supply system according to the present invention, a control operation in which the delay of response from a time of the supply of the air intake side secondary air to a time of detection of the oxygen concentration in the exhaust gas is taken into account, is performed so that the hunting of the air/fuel ratio is prevented. More precisely, the integration control operation is executed in such a manner that the subtraction value $I_L$ is subtracted from the correction value $I_{OUT}$, or the summing value $I_R$ is added to the correction value $I_{OUT}$ every time of the elapse of the predetermined time period $\Delta t_1$. Also, the proportional term control operation is performed in such a manner that the subtraction value $P_L$ which is greater than the subtraction value $I_L$ is subtracted from the correction value $I_{OUT}$ when it is detected from the output signal level of the oxygen concentration sensor 14 that the air/fuel ratio of the mixture has changed from rich to lean, and the summing value $P_R$ which is greater than the summing value $I_R$ is added to the correction value $I_{OUT}$ when the air/fuel ratio of the mixture has changed from lean to rich.

Further, in the air intake side secondary air supply system according to the present invention, the air/fuel ratio control is performed with a target air/fuel ratio which can be set to be leaner than the stoichiometric air/fuel ratio by using an oxygen concentration sensor whose output signal characteristic is shown in FIG. 2. Therefore, the fuel consumption can be reduced without a tradeoff of the driveability.

In the above explained preferred embodiment, the time period $\Delta t_1$ is set constant, however, the system may be constructed such that the time period $\Delta t_1$ can be varied in response to operating conditions of the engine. For instance, by reducing the time period $\Delta t_1$ when the engine speed is high, or when the amount of the intake air is large, the response characteristic can be improved.

Further, the time counter B is incorporated in the CPU 29 in the above embodiment. However, the time counter B can be provided outside the CPU 29, and the system can be constructed such that the valve open command is supplied to the drive circuit 28 when the count value of the time counter B has reached to "0".

In view of the foregoing, it will be appreciated that, in the air intake side secondary air supply system according to the present invention, the base valve open period of the open/close valve in each duty cycle which is set in response to a plurality of predetermined operating parameters, is increased or decreased on the basis of the output signal level of the oxygen concentration sensor. Thus, the duty ratio of the supply of the air intake side secondary air is controlled by the PI (Proportional and Integral) operation. The air/fuel ratio of the mixture is controlled very rapidly toward the target air/fuel ratio in this way.

What is claimed is:

1. An air intake side secondary air supply system for an internal combustion engine having an intake air passage with a carburettor and an exhaust gas passage, comprising:

an air intake side secondary air supply passage leading to the intake air passage, at a position downstream of said carburettor;

an open-close valve disposed in said air intake side secondary air supply passage;

an oxygen concentration sensor disposed in said exhaust passage and producing an output signal whose level is generally proportional to an oxygen concentration of an exhaust gas of the engine; and duty control unit responsive to said output signal of said oxygen concentration sensor and operative to control said open-close valve, including means for determining a base valve open time period in a duty cycle of a predetermined time period using a plurality of predetermined operational parameters of said engine at an interval of said predetermined time period, means for detecting whether an air/fuel ratio of a mixture supplied to the engine is leaner or richer than a target air/fuel ratio at most an interval of said predetermined time period, means for calculating an output valve open period by decreasing said base valve open time period by a first correction value when a result of the detection of said air/fuel ratio is "lean", and by increasing said base valve open time period by a second correction value when the result of the detection of said air/fuel ratio is "rich", and means for opening said open/close valve during said output valve open period in each of said duty cycle, wherein said duty control unit further includes means for increasing said first correction value only when the air/fuel ratio of the mixture has changed from rich to lean with respect to said target air/fuel ratio, and increasing said second correction value only when the air/fuel ratio of the mixture has changed from lean to rich with respect to said target air/fuel ratio.

* * * * *